United States Patent [19]

Berg et al.

[11] Patent Number: 4,961,446

[45] Date of Patent: Oct. 9, 1990

[54] CONTAINER FILLING SYSTEM

[75] Inventors: Marvin I. Berg, Tacoma; Stavros Mihail, Seattle; John E. Oman, Edmonds, all of Wash.

[73] Assignee: Promation Incorporated, Seattle, Wash.

[21] Appl. No.: 374,522

[22] Filed: Jun. 29, 1989

Related U.S. Application Data

[63] Continuation-in-part of Ser. No. 271,385, Nov. 9, 1988, Pat. No. 4,893,660, which is a continuation of Ser. No. 81,972, Aug. 5, 1987, abandoned.

[51] Int. Cl.[5] ..... B65B 39/12

[52] U.S. Cl. ..... 141/144; 141/71; 141/81; 141/137; 141/147

[58] Field of Search ..... 141/129, 135–144, 141/146, 147, 178, 179, 234, 236, 248, 238, 242, 258, 71.81

[56] References Cited

U.S. PATENT DOCUMENTS

| | | | |
|---|---|---|---|
| 2,127,393 | 8/1938 | Doney . | |
| 2,562,815 | 7/1951 | Oscroft | 141/236 X |
| 2,564,969 | 8/1951 | Goldberg . | |
| 2,939,407 | 6/1960 | Keathley, Sr. et al. . | |
| 3,186,140 | 6/1965 | Bogdanovich . | |
| 3,217,944 | 11/1965 | Bell et al. | 222/350 |
| 3,258,041 | 6/1966 | Lau | 141/10 |
| 3,513,626 | 5/1970 | Zhavoronkova et al. . | |
| 3,695,486 | 10/1972 | Warner | 141/242 X |
| 3,780,490 | 12/1973 | Schack et al. . | |
| 3,820,194 | 6/1974 | Thiesen | 17/32 |
| 3,864,891 | 2/1975 | Piereder . | |
| 4,068,008 | 1/1978 | Orchard | 426/272 |
| 4,373,560 | 2/1983 | Elsworth | 141/129 |
| 4,582,103 | 4/1986 | Piereder | 141/238 |
| 4,893,660 | 1/1990 | Berg et al. | 141/144 |

FOREIGN PATENT DOCUMENTS 0229995 7/1987 European Pat. Off. .

*Primary Examiner*—Ernest G. Cusick

*Attorney, Agent, or Firm*—Christensen, O'Connor, Johnson & Kindness

[57] ABSTRACT

A container filling system is disclosed that produces controlled volumes and weights of filler material for discharge into containers. The system includes a material feed subsystem that provides a source of longitudinally aligned filler material of uniform density or a plug flow of substantially homogenous, amorphous filler material. A rotating measuring subsystem includes measuring chambers that receive predetermined amounts of the material for transfer to a discharge subsystem. The material is transferred into the measuring chambers in an axial direction and is transferred for discharge into the containers in the same direction. More particularly, the rotating discharge subsystem includes a plurality of discharge stations that receive both the measuring chambers and containers immediately below the chambers. Plungers are supported above the measuring chambers and are vertically controlled by a cam to move downward with rotation of the discharge subsystem. As a result, the material is forced from the measuring chambers into the containers. Continued rotation of the discharge subsystem effects the removal of the containers from the discharge subsystem and the transfer of the measuring chambers back to the measuring subsystem.

20 Claims, 11 Drawing Sheets

P.R.V.
12
24
28
29
30
31
32
33
34
35
36
37
38
39
41
43
45
46
47
49
51
53
55
57
59

CONTAINER FILLING SYSTEM

RELATED APPLICATIONS

This application is a continuation-in-part of copending application Ser. No. 07/271,385, filed Nov. 9, 1988, now U.S. Pat. No. 4,893,660 issued Jan. 16, 1990, which is a continuation of application Ser. No. 07/081,972, filed Aug. 5, 1987, now abandoned.

TECHNICAL FIELD

This invention relates generally to container filling systems and, more particularly, to systems for introducing controlled volumes or uniform weights of filler material into containers.

BACKGROUND OF THE INVENTION

In numerous applications, bulk quantities of material are required to be dispensed into containers for distribution to a consuming public. For example, in the fish-processing industry, portions of butchered fish having their heads, fins, and entrails removed are often commercially distributed in hermetically sealed cans. The result is a conveniently sized product having a relatively long storage life. Because government regulations set maximum acceptable deviations between the actual and advertised product weights, it is necessary to ensure that some minimum weight of the butchered fish is inserted into each can. Given the relatively high volume of cans processed in this industry, however, even slight variations in container weight over the acceptable minimum are undesirable. More particularly, over the course of a production run, these weight variations cumulatively represent a significant raw material cost to the processor.

In addition to the raw material cost involved in the production of "overweight" cans, several inefficiencies in the speed of processing are typically present in conventional container filling systems. For example, if the weight of the initial portion of butchered fish introduced into a can is below the level accepted by government regulation, an additional operation is required to bring it up to weight. This process is both time-consuming and costly, particularly where the weight of a significant percentage of filled cans must be adjusted.

Another inefficiency results when the container filling system experiences inherent delays caused, for example, by the inequality of time required to perform various sequential operations. As will be appreciated, in applications where millions of containers are to be filled, even slight delays in the time required to process a single container present substantial inefficiencies.

Although its influence on a processing industry may be less direct than the inefficiencies noted above, in certain applications the dispensed material may vary considerably in attractiveness from one container to the next. For example, when butchered fish are canned with conventional equipment, large unattractive pieces of skin may be left exposed on the upper surface of some cans when opened. In addition, the orientation of the meat, or direction of its grain, may vary considerably throughout the can, failing to present the image of a substantially uniform, single piece of meat.

Lastly, the incidental presence of skin or bones around the flange of the can may prevent the can from being properly sealed. As will be appreciated, the resultant seam defect prevents a vacuum from being maintained within the can and will eventually contribute to the spoilage of the contents. Because of the health hazard presented by such spoilage, the production of even a small percentage of containers with seam defects is to be avoided.

In light of these observations, it would be desirable to produce a system for use in the high speed filling of containers with accurate weights and volumes of material, while simultaneously providing a more attractive and safe container filling system.

SUMMARY OF THE INVENTION

In accordance with this invention, a container filling system is provided for introducing controlled volumes of filler material into containers. The system includes a measuring chamber for receiving a predetermined volume of filler material and a feed subsystem for introducing filler material into the measuring chamber under pressure and along a first axis defined with respect to the measuring chamber. A discharge subsystem discharges material from the measuring chamber along the first axis and into one of the containers. A coupler transfers the measuring chamber from the feed subsystem to the discharge subsystem.

In accordance with a particular aspect of this invention, the system further includes a rotatable measuring station for controlling the introduction of filler material from the feed subsystem into the measuring chamber. A rotatable discharge station controls the discharge of filler material by the discharge subsystem from the measuring chamber into one of the containers.

BRIEF DESCRIPTION OF THE DRAWINGS

The invention will presently be described in greater detail, by way of example, with reference to the accompanying drawings, wherein.

DETAILED DESCRIPTION OF THE PREFERRED EMBODIMENT OF THE INVENTION

Figure 1:
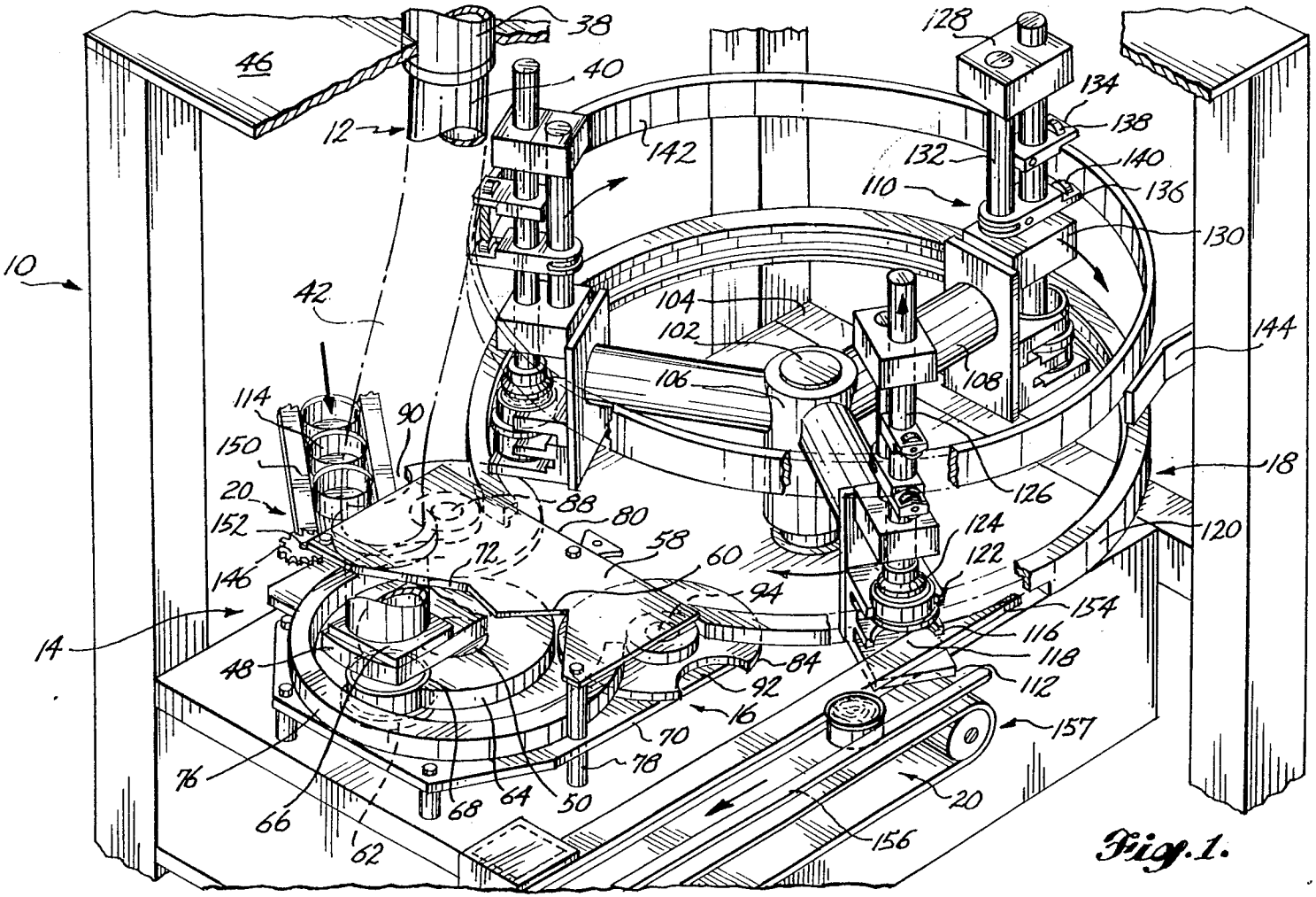
FIG. 1 is a pictorial view of a container filling system constructed in accordance with this invention, including a rotatable measuring station at which precisely controlled portions of filler material are produced and a rotatable discharge station at which the portions of material are discharged into containers.

Referring now to FIG. 1, a container filling system 10 constructed in accordance with this invention is shown. As will be appreciated, system 10 can be used to dispense a variety of bulk filler materials into numerous types and sizes of containers. In the preferred embodiment, however, system 10 is used to dispense precisely controlled portions of butchered fish, having their heads, fins and entrails removed, into cans. A container filling system formed in accordance with the present invention can also be used to dispense precisely controlled portions of fillets of whole butchered fish that have had their heads, fins, and entrails removed.

As shown in FIG. 1, the container filling system includes a number of subsystems. A material feed subsystem 12 (partially shown) receives a bulk supply of randomly aligned, butchered fish in water. Feed subsystem 12 then aligns or orients the fish under pressure, packs them, and removes the water to provide a source of aligned fish that is of substantially uniform density.

From the material feed subsystem 12, the aligned and compressed fish are advanced to a measuring subsystem 14. Measuring subsystem 14, which operates in a continuous rotational pattern, produces portions of closely controlled weight and volume from the fish supplied by feed subsystem 12. These measured portions of fish are then advanced to a transfer subsystem 16.

Transfer subsystem 16 transfers the controlled portions of fish produced by measuring subsystem 14 to a discharge subsystem 18. The continuously rotating discharge subsystem 18 dispenses the precisely controlled portions of fish produced by measuring subsystem 14 into containers advanced through the discharge subsystem 18 by a container advance subsystem 20. To ensure that the various subsystems described above operate in synchronization, a common synchronized drive subsystem 22 is provided.

Figures 2, 3:
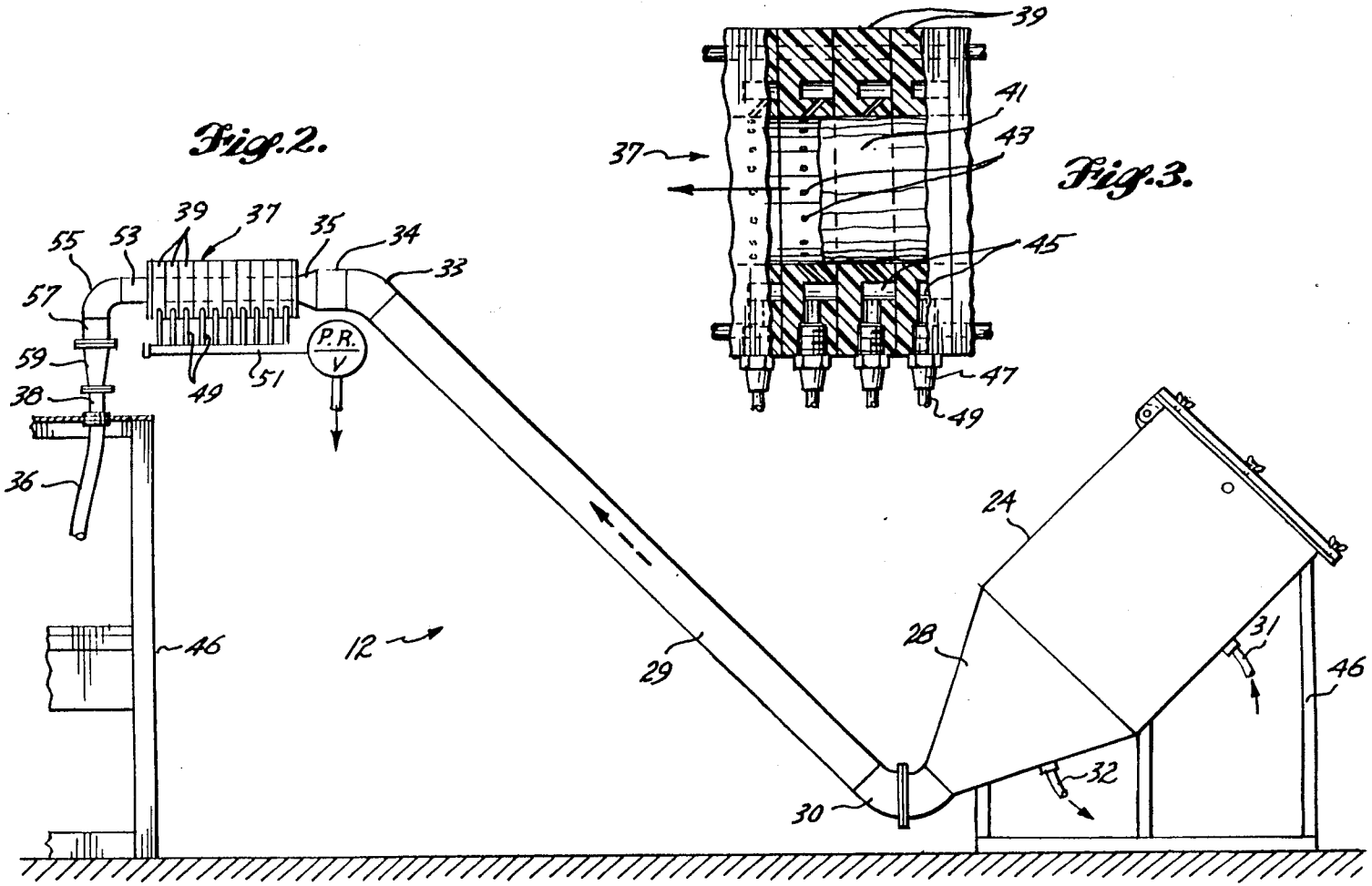
FIG. 2 is a pictorial view of a feed subsystem used in connection with the container filling system of FIG. 1.
FIG. 3 is a sectional view of a portion of the feed subsystem of FIG. 2 illustrating a dewatering station in the subsystem.

Addressing the various subsystems of container filling system 10 in greater detail, reference is initially had to the material feed subsystem 12 shown in FIGS. 1, 2, 3 and 4. As shown in FIG. 2, feed subsystem 12 includes a tilted hopper 24 designed to receive and temporarily store a supply of butchered fish 26, in water, that is sufficient to allow system 10 to continue operation for short periods, even without the receipt of additional fish 26 by hopper 24. As will be appreciated, the inclusion of water allows the fish 26 to be pumped under pressure directly from a butchering station into hopper 24.

Hopper 24 has a base 28 that is preferably shaped like the frustum of a cone. The resultant taper of the base 28, which is connected to a tubular transfer section 29 by an elbow 30, allows gravity to assist the introduction of butchered fish 26 into the elbow 30 and transfer section 29. The transfer of fish 26 into, and through, section 29 may be further assisted by the establishment of a pressure in the hopper 24 that is greater than that of the surrounding atmosphere and the maintenance of an adequate flow of water, both of which may be accomplished with the aid of inlet and outlet ports 31 and 32. The tapered base 28, elbow 30, and transfer section 29 are dimensioned to cooperatively orient the butchered fish 26 substantially longitudinally in transfer section 29. More particularly, fish 26 will be oriented such that their backbones are disposed substantially along the axis of section 29 as they travel through section 29.

Attached to the upper end of the transfer section 29 is an elbow 33 that extends into a horizontal section 34. Section 34 is followed by a compression section 35 that is shaped like the frustum of a cone. As will be appreciated, the variation in the diameter of section 35 effects a compression of the fish traveling therethrough. A dewatering station 37 follows section 35 to remove the water that has previously been used to transport butchered fish 26 in alignment through subsystem 12. As shown, station 37 includes a plurality of sections 39 that each have a cylindrical bore 41 extending therethrough. The various sections 39 are coupled end-to-end to define a continued passage for the butchered fish 26 received from section 35.

As shown in FIG. 3, the bore 41 of each section 39 of the dewatering station 37 is provided with a plurality of circumferentially spaced-apart ports 43 that allow water to escape. A channel 45 is provided in each section 39, extending circumferentially around bore 41 and in fluid communication with the ports 43. Each channel 45 is connected via a coupler 47 to an individual line 49 of a water outlet system 51. As will be appreciated, the number of sections 39 and ports 43 can be varied to provide the desired dewatering characteristics. Similarly, valves can be included in lines 49 to control the escape of water through the ports 43 of each section 39 in any manner desired.

While the flow of water aids the longitudinal transport of butchered fish 26 through subsystem 12 prior to reaching station 37, the diameter of the passage through station 37 is sufficiently small to maintain the butchered fish 26 received therein in substantial alignment. From station 37, the aligned fish 26 traverse a short horizontal section 53 of tube, followed by a 90° elbow 55, and a short vertical section 57 of tube. As this point, the butchered fish 26 move downward into a second compression section 59.

Compression section 59 is shaped like the frustum of a cone and is dimensioned to effect the desired compression of butchered fish 26. More particularly, section 59, in cooperation with the applied hopper pressure, is designed to compress the dewatered and aligned fish 26 sufficiently to produce a continuous, aligned pack of substantially uniform density for advance to the measuring subsystem 14.

Figure 4:
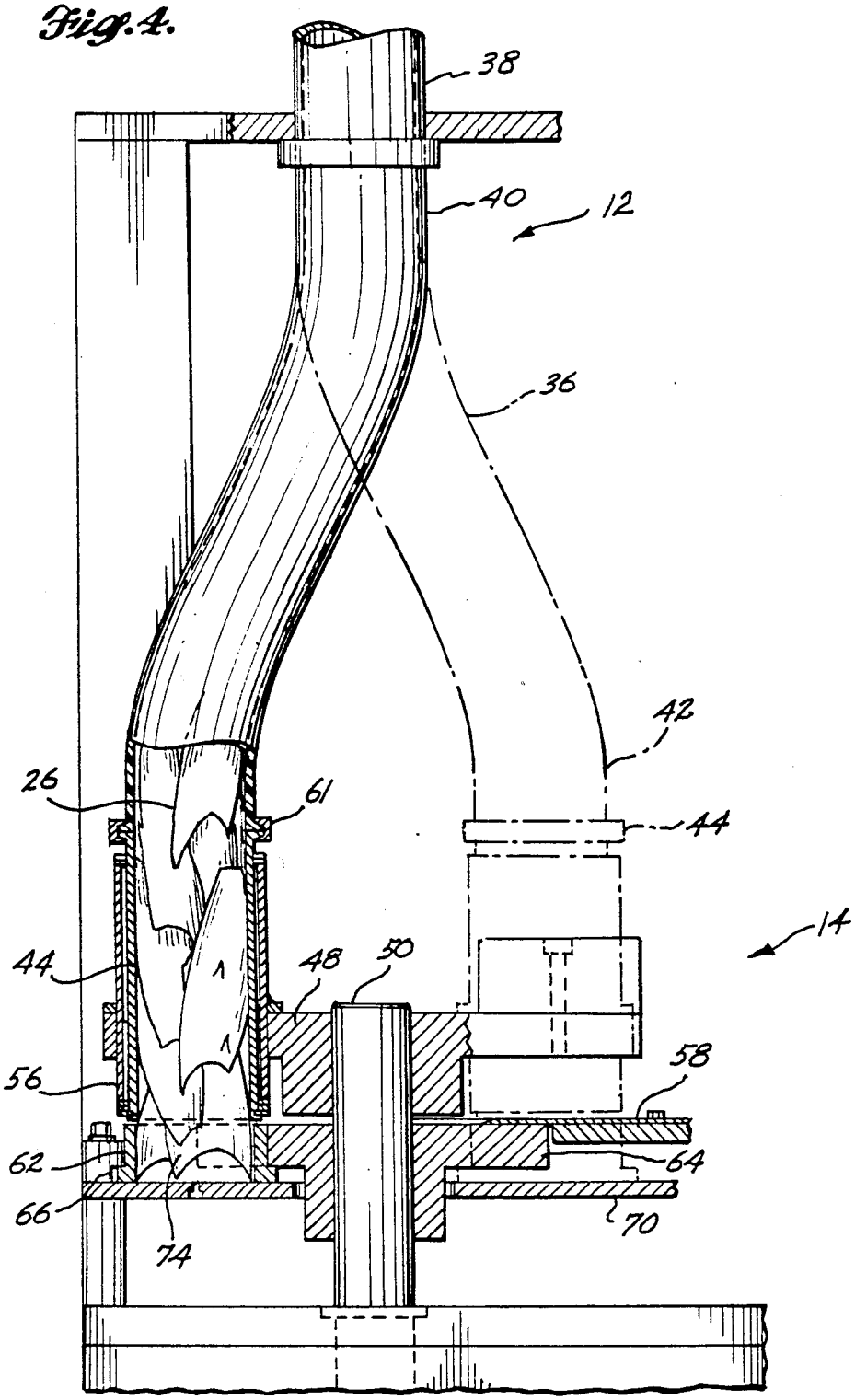
FIG. 4 is a vertical section of the measuring station of FIG. 1.

As with the preceding elements of the material feed subsystem 12, which are rigid and fixedly attached and sealed in sequence, the outlet of the tapered compression section 59 is securely connected to a flexible transfer tube 36. The diameter of transfer tube 36 corresponds to that of the lower end of section 59. As shown in FIG. 2, the connection between section 59 and tube 36 is provided by a collar 38 that provides a relatively fluid-tight seal. While the upper end 40 of tube 36 is fixed, as shown in FIG. 4, the lower end 42 of tube 36, which is connected to the rotating measuring subsystem 14 by a standard sanitary couple 61, undergoes horizontal translation in a circular pattern. The resultant offset alignment of the upper and lower ends 40 and 42 of tube 36 introduces two slight elbows in the tube 36, with the offset being limited sufficiently to allow the relatively unimpeded progress of packed fish 26 through the feed subsystem 12. Although not described in detail, it will be appreciated that the preceding elements of the material feed subsystem 12 are supported by a feed subsystem support structure 46.

Figure 5:
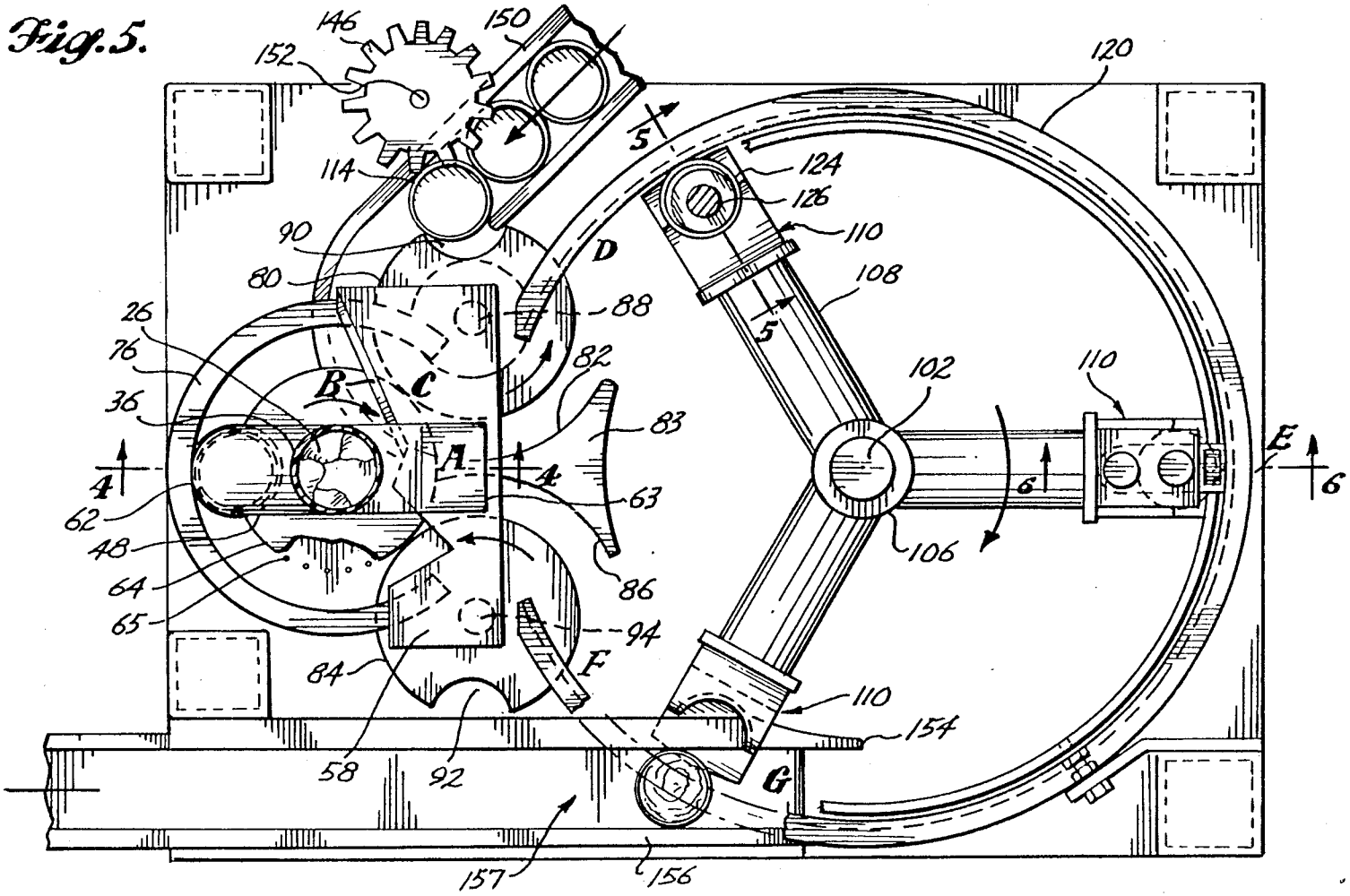
FIG. 5 is a horizontal section of the system of FIG. 1 illustrating the path of advance of the filler material through the measuring and discharge stations.

Turning now to a description of the measuring subsystem 14, as shown in FIGS. 1, 4 and 5, it includes a flat, roughly rectangular guide plate 48 that is supported for horizontal rotation about a vertical shaft 50. A cylindrical guide 56 passes through plate 48 adjacent one end and extends above and below plate 48. A counterweight 63 is attached to the other end of plate 48 for balanced operation. A sleeve 44, having an inner diameter corresponding to that of tube 36, is received within guide 56 and extends slightly above guide 56 to provide the desired connection with tube 36 at couple 61. In this manner, a supply of butchered fish 26 that is substantially aligned and of substantially uniform density is made available to the rotating measuring subsystem 14 under the direction of guide 56.

As will be appreciated from FIGS. 1 and 5, as plate 48 and shaft 50 undergo one complete rotation, the lower surface of guide 56 sweeps out a path that, for part of the rotation, traverses the upper surface of a knife plate 58. When guide 56 is positioned over knife plate 58, the spacing between the two parts is sufficiently closely toleranced so that the advance of the fish pack 26 is limited by the upper surface of knife plate 58. As soon as plate 48 has rotated sufficiently for guide 56 to clear the "trailing" edge 60 of knife plate 58, however, the knife plate 58 will no longer restrict the advance of packed fish 26 through guide 56.

At the same time that guide 56 clears edge 60 of knife plate 58, a measuring chamber 62 that is vertically aligned with guide 56 in a plane below plate 58 is advanced past edge 60 by a horizontal chamber guide wheel 64 rotating in synchronization with guide plate 48. Measuring chamber 62 is a substantially cylindrical ring having a boss 66 projecting radially about its lower surface. Measuring chamber 62 is dimensioned to define a volume that corresponds to a predetermined mass of fish 26 when packed fish 26 having a particular density are introduced into chamber 62. The chamber guide wheel 64 is rotatably secured to shaft 50 and includes a recess 68 at its perimeter that is dimensioned to receive measuring chamber 62 and engage boss 66. Because the chamber guide wheel 64 is affixed to the same vertical shaft 50 as guide plate 48, with the chamber guide wheel recess 68 aligned with the fish guide 56 on guide plate 48, the vertical alignment of the measuring chamber 62 and the fish guide 56 is ensured as the trailing edge 60 of knife plate 58 is passed.

Although both the top and bottom of measuring chamber 62 are open, chamber 62 rides on a base plate 70 that prevents the escape of packed fish 26 from the bottom of chamber 62 when packed fish 26 are introduced under pressure through guide 56. Similarly, because guide 56 and measuring chamber 62 are relatively closely spaced, the escape of packed fish 26 from the top of chamber 62 is substantially prevented. To speed the entry of packed fish 26 into measuring chamber 62 after the trailing edge 60 of knife plate 58 is passed, a series of circumferentially aligned ports 65 are included in base plate 70. As will be appreciated, with a vacuum applied to ports 65, fish 26 is more readily drawn into chamber 62.

As the chamber guide wheel 64 and guide plate 48 continue to rotate the measuring chamber 62 and guide 56 in synchronization, the knife edge 72 of knife plate 58 is eventually reached. As shown, knife edge 72 is displaced at an angle with respect to the path of advance of guide 56 and measuring chamber 62 to cleanly sever the fish pack 26 between guide 56 and measuring chamber 62. As a result, a portion 74 of longitudinally aligned fish 26 having a closely controlled weight is produced in measuring chamber 62.

As will be appreciated from FIGS. 1 and 5, the control of measuring chamber 62, as it is advanced through the filling and severance operations described above, is accomplished by chamber guide wheel 64 in cooperation with a guide rail 76. Guide rail 76 extends over an arc of approximately 270° and limits the radial movement of measuring chamber 62 as it is rotated through measuring subsystem 14 by guide wheel 64. Like the recess 68 in chamber guide wheel 64, guide rail 76 is designed to loosely engage the outer surface of the measuring chamber 62, including boss 66. As will be appreciated, guide rail 76 is horizontally secured to the base plate 70, which, along with vertical shaft 50 and knife plate 58, is supported by a measuring subsystem support structure 78.

Turning now to a more detailed discussion of the transfer subsystem 16, as shown in FIGS. 1 and 5, subsystem 16 includes a forward chamber guide wheel 80 that cooperates with a forward guide surface 82 of a rail 83 to transfer measuring chamber 62 from measuring subsystem 14 to the discharge subsystem 18 after the desired portion 74 of fish 26 is produced in the chamber 62. Subsystem 16 also includes a return chamber guide wheel 84 that cooperates with a return guide surface 86 formed on the opposite side of rail 83, to return measuring chamber 62 to measuring subsystem 14 after the portion 74 has been dispensed into a container by the discharge subsystem 18.

Considering these elements of the transfer subsystem 16 individually, the forward chamber guide wheel 80 is a roughly circular plate, corresponding in dimension to wheel 64 and mounted for horizontal rotation about a vertical drive shaft 88. Guide wheel 80 includes a recess 90 that is designed to cooperatively engage the measuring chamber 62 and advance it along guide rail surface 82 as the guide wheel 80 is rotated. Guide rail surface 82 defines an arc of approximately 90° and guide rail 83 is secured to the same base plate 70 as the measuring subsystem guide rail 76. The interaction between the chamber guide wheel 64 and guide rail 76 of measuring subsystem 14 and the transfer system guide wheel 80 and guide rail 83 is synchronized by providing the proper initial orientation of vertical shafts 50 and 88 and then rotating them at the same speed. As a result, measuring chamber 62 is advanced by guide wheel 64 to the end of guide rail 76, at which point the guide surface 82 of rail 83 initiates the guidance of measuring chamber 62 under the influence of guide wheel 80.

As noted previously, the forward guide wheel 80 and guide rail surface 82 advance measuring chamber 62 from measuring subsystem 14 to the discharge subsystem 18, which dispenses portion 74 into a container and returns chamber 62 to the return guide wheel 84 and guide rail surface 86. Return guide wheel 84 and guide rail surface 86 are of substantially the same construction as, and provide a mirrored operation of, forward guide wheel 80 and guide rail surface 82. More particularly, wheel 84 and surface 86 cooperatively receive measuring chamber 62 as it exits the discharge subsystem 18 and transfer it in an arcuate path until control of chamber 62 is resumed by the measuring subsystem guide wheel 64 and guide rail 76.

Like the forward guide wheel 80, return guide wheel 84 is an approximately circular plate that includes a recess 92 constructed to receive the measuring chamber 62. Wheel 84 is secured for horizontal rotation about a vertical shaft 94. The guide surface 86 of rail 83 defines an arc of approximately 90°.

Figure 7:
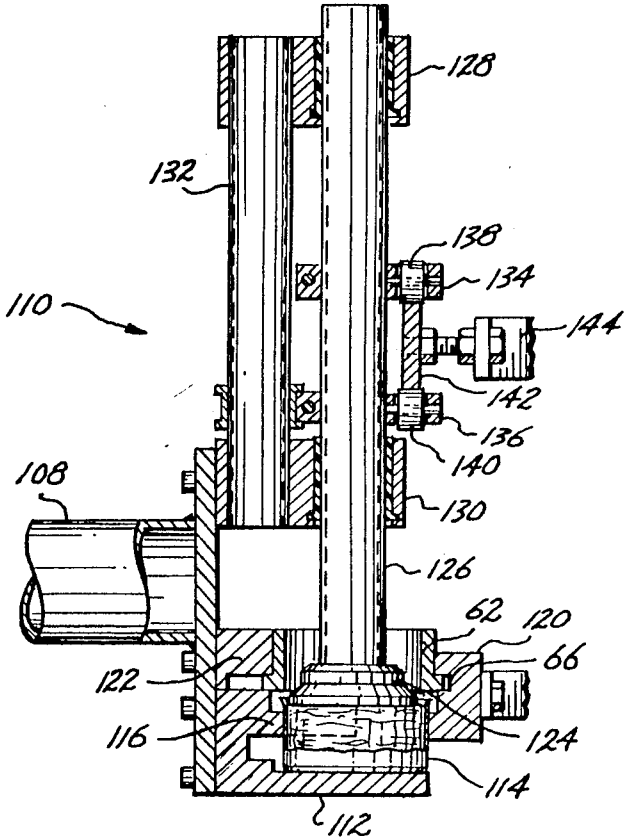
FIG. 7 is a vertical section of a portion of the discharge station of FIG. 1 illustrating the position of the discharge station after the filler material has been discharged into a container.
Figure 6:
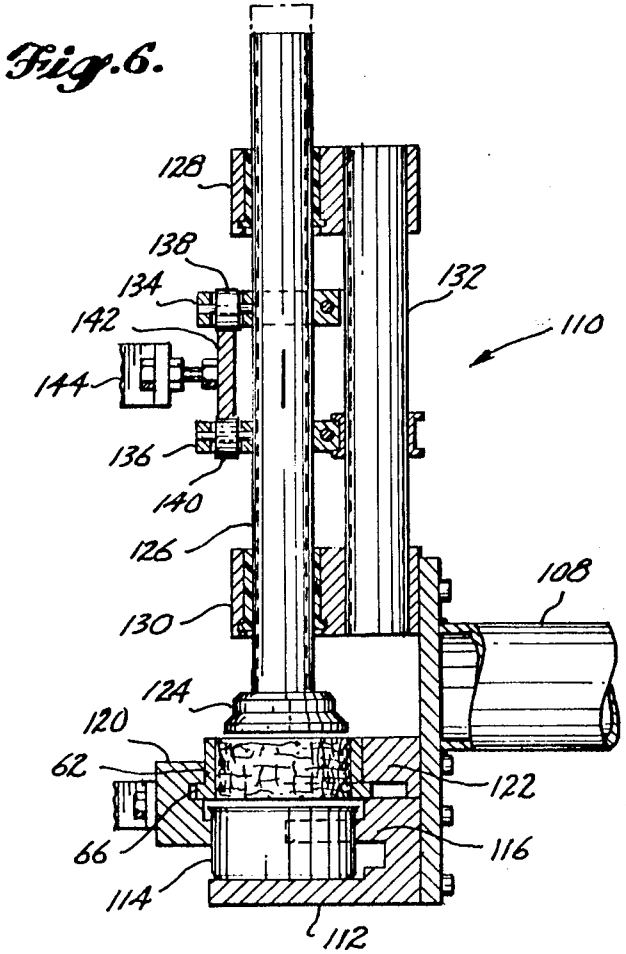
FIG. 6 is a vertical section of a portion of the discharge station of FIG. 1 illustrating the position of the discharge station prior to the discharge of filler material into a container.

Turning now to a discussion of the discharge subsystem 18, as shown in FIGS. 1, 6 and 7, discharge subsystem 18 includes a discharge assembly 104 that receives empty containers and filled measuring chambers in vertical alignment and discharges the portions 74 of fish into the containers. The discharge assembly 104 is secured to a vertical shaft 102 by a hub 106 and, as a result, is horizontally rotatable. In the preferred arrangement, three arms 108, located approximately 120° apart, project radially from hub 106. At the end of each arm 108 is a discharge station 110, where the actual transfer of portion 74 from measuring chamber to container occurs.

Each discharge station 110 includes a horizontally disposed platform 112 for receiving and supporting a container 114. The container 114 is further supported by a horizontal container receiving plate 116 that is spaced slightly above platform 112 and that includes a semicircular recess for receiving and engaging a portion of the side of container 114. Plate 116 and a guide rail 120 that is disposed about discharge assembly 104 cooperatively retain the container 114 on platform 112 as the discharge assembly 104 is rotated about shaft 102.

The vertical position of platform 112 and plate 116 is such that a container 114 is supported for rotation through the discharge subsystem 18 at a level below the base plate 70. Vertically aligned with base plate 70 on each discharge station 110 is a measuring chamber receiving plate 122. As will be appreciated, each chamber receiving plate 122 is located above the corresponding container receiving plate 116 and is recessed and slotted to receive the measuring chamber 62 and support it via boss 66. The chamber receiving plate 122 also cooperates with the guide rail 120, which extends vertically to the level of plate 122, to retain the measuring chamber 62 in vertical alignment with container 114 as the discharge assembly 104 rotates about vertical shaft 102.

To effect the discharge of portion 74 from chamber 62 into container 114, a plunger tip 124 is secured to the lower end of a vertically aligned plunger arm 126 disposed above chamber 62. The plunger arm 126 is slidably received between upper and lower support brackets 128 and 130 that are spaced apart by a support arm 132 and fixed with respect to station 110. The vertical displacement of plunger arm 126 is controlled by upper and lower bearing plate assemblies 134 and 136 that are secured to plunger arm 126 a spaced-apart distance between the upper and lower support brackets 128 and 130. The projecting ends of bearing plate assemblies 134 and 136 are equipped with bearings 138 and 140, which cooperatively engage a cam 142 that controls the vertical displacement of assemblies 134 and 136 and, hence, plunger arm 126.

Cam 142 is a continuous loop of material having a rectangular cross section and is supported around the discharge assembly 104 by a support structure 144. The vertical height of cam 142 with respect to, for example, the arms 108 of the discharge assembly 104 varies approximately sinusoidally over 360°. Given the cooperation of bearing plate assemblies 134 and 136 with the cam 142, it will be appreciated that as discharge assembly 104 rotates, the variation in the height of cam 142 over the arms 108 effects a corresponding displacement in the plunger tip 124.

As will be described in greater detail below, the orientation of cam 142 with respect to the discharge assembly 104 is such that the receipt of a filled measuring chamber 62 by a station 110 corresponds to a downward slope in cam 142, causing the plunger tip 124 to move downward and force the portion 74 of fish from chamber 62 into the container 114 below. The diameter and alignment of plunger tip 124, measuring chamber 62, and container 114 are such that air is easily vented from container 114 as the portion 74 of fish is inserted. More particularly, the plunger tip 124 is slightly smaller in diameter than container 114 and its axis is offset from the center of the container 114 supported on platform 112. Alternatively, as described in more detail below, means can be provided to evacuate air from the interior of the containers prior to inserting the filler material. As will be appreciated, the discharge station 110 continues to rotate back toward the transfer subsystem 16 as container 114 is filled and eventually the cam 142 will exhibit an upward slope causing the plunger tip 124 to be withdrawn from chamber 62.

Figure 8:
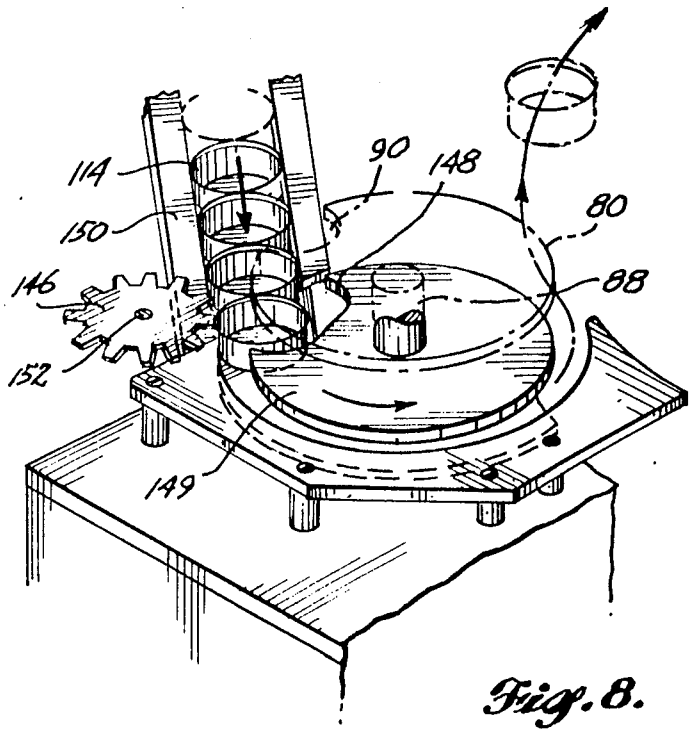
FIG. 8 is a pictorial view of a container introduction station included in the system of FIG. 1.

Turning now to a discussion of the container advance subsystem 20, reference is had to FIGS. 1, 5 and 8. Subsystem 20 is responsible for the introduction and removal of containers 114 from the horizontally disposed platforms 112 of the rotating discharge stations 110. The introduction of a container 114 onto each platform 112 is accomplished through the use of a rubber acceleration wheel 146 that accelerates containers 114 from their resting place in a rack 150 and into the cammed recess 148 of a rotating timing wheel 149. More particularly, the horizontal rotation of the tined acceleration wheel 146 about vertical shaft 152 causes the wheel's tines to engage the forwardmost container 114 in rack 150 and accelerate and direct it into the cammed recess 148. Cammed recess 148 is designed to, first, receive the accelerated container 114 and, then, guide it in a controlled and timed fashion onto platform 112. As will be appreciated, this control is achieved by the horizontal rotation of timing wheel 149 about vertical shaft 88 in synchronization with the rotation of chamber guide wheel 80 and discharge assembly 104. In this manner, a smooth transfer of the container 114 into the discharge subsystem 18 is affected.

To remove the containers 114 from platforms 112, a projecting arm 154 is positioned in the horizontal path of the containers 114 just prior to the rotation of discharge assembly 104 back to the return wheel 84 of transfer subsystem 16. The projecting arm 154, in cooperation with a guide rail 156, directs containers 114 from platform 112 to a conveyor system 157 for further processing or packaging, including, for example, the hermetic sealing of containers 114.

Figure 9:
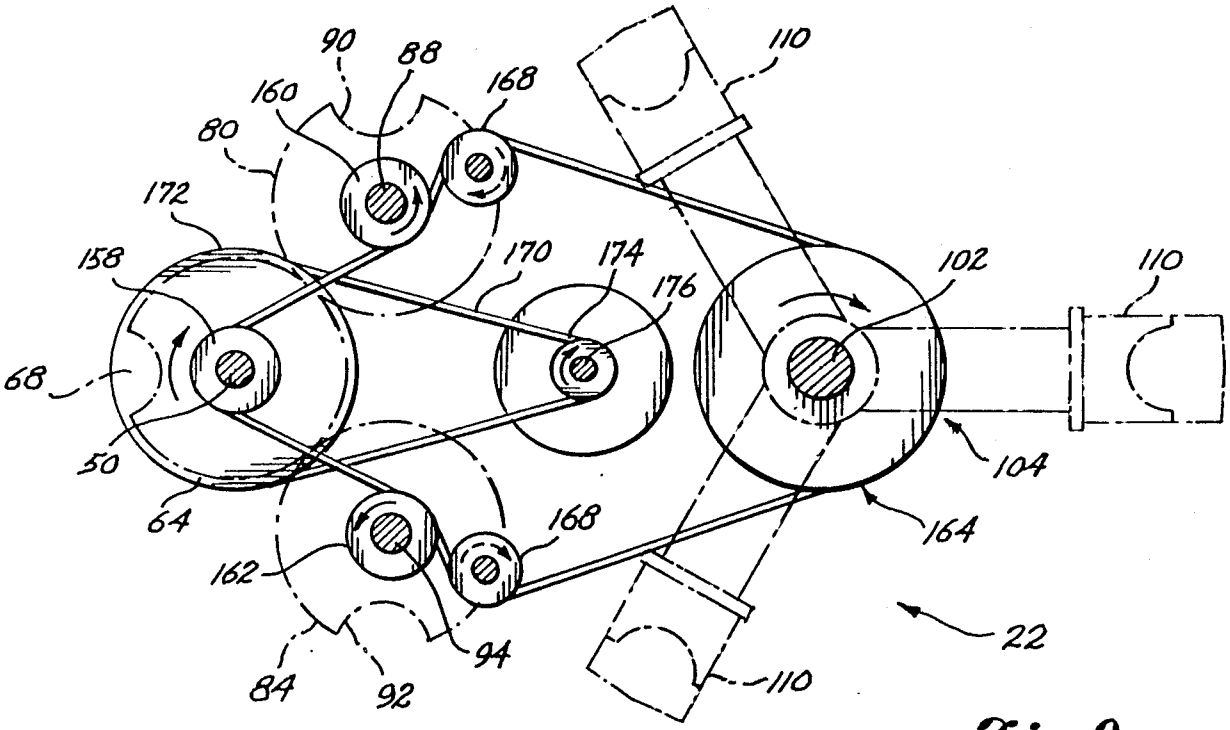
FIG. 9 is a horizontal section of the system of FIG. 1 illustrating a synchronized drive subsystem used to provide the desired relative orientation and operation of the system components.

As noted previously, the required synchronous operation of the various subsystems is maintained by the synchronized drive subsystem 22, located in part below base plate 70. More particularly, as shown in FIG. 9, the synchronized drive subsystem 22 includes a plurality of pulleys 158, 160, 162 and 164 coupled to vertical shafts 50, 88, 94 and 102, respectively. A belt 166 traverses pulleys 158, 160, 162 and 164, along with two tensioning pulleys 168. A second belt 170 traverses a second pulley 172 on shaft 50 and a drive pulley 174 secured to a main drive shaft 176. As a result, the rotation of drive shaft 176 effects the desired synchronous rotation of shafts 50, 88, 94 and 102. By properly dimensioning the various pulleys 158, the desired relative rotational rates and angular alignments of the subsystem components can be achieved. In particular, shafts 50, 88 and 94 are rotated at three times the speed of shaft 102. As will be appreciated, drive subsystem 22 may alternatively employ gears or chain-and-sprocket combinations to synchronously drive the various shafts.

Reviewing now the overall operation of the container filling system 10, reference is again had to FIG. 1. Operation will be assumed to commence with a hopper 24 full of butchered fish and aligned, dewatered and compressed fish 26 being available at the end of the flexible transfer tube 36. Measuring chambers 62 are provided in the recesses 68, 90, and 92 of chamber guide wheels 64, 80, and 84, as well as in the measuring chamber receiving plate 122 of each discharge station 110. Similarly, a supply of containers 114 is available and containers 114 are appropriately positioned on each platform 112 of the discharge stations 110.

Following one measuring chamber 62 through the entire filling system 10, let us begin with the guide plate 48 and guide 56 of measuring subsystem 14 rotated to the position designated A in FIG. 5. As shown in the broken line view of FIG. 4, at this point, measuring chamber 62 is located below knife plate 58 and is being advanced toward the trailing edge 60 of the knife plate 58. As the chamber guide wheel 64 rotates measuring chamber 62 past trailing edge 60, the guide 56 coupled to flexible transfer tube 36 above knife plate 58 simultaneously passes trailing edge 60, forcing the pressurized, longitudinally aligned fish 26 of substantially uniform density into the measuring chamber 62 against base plate 70, as shown in FIG. 4.

As measuring chamber 62 is further rotated by guide wheel 64, it eventually reaches the knife edge 72 of knife plate 58, designated B in FIG. 5. The knife edge 72 passes between the vertically spaced measuring chamber 62 and guide 56, severing a portion 74 of fish having a predetermined volume. Given the relatively uniform density of the fish traversing flexible tube 36, portion 74 will also exhibit a relatively closely toleranced weight. In addition, given the longitudinal alignment and compression of the fish pack 26 within tube 36 and chamber 62, the portion 74 will have a relatively uniform appearance when viewed from above, the skin of fish 26 being seen primarily in cross section, and will not interfere with sealing of the container 114.

Further rotation of guide wheel 64 advances measuring chamber 62 to the end of guide rail 76. At this point, designated C in FIG. 5, the forward transfer guide wheel 80 and guide rail surface 82 of transfer subsystem 16 engage measuring chamber 62 and transport it in an arcuate path covering approximately 90° until chamber 62 is engaged by the measuring chamber receiving plate 122 of a discharge station 110 on the synchronously rotating discharge assembly 104.

Given the introduction of a container 114 onto platform 112 by the acceleration wheel 146, the container 114 is positioned immediately below the portion 74 in measuring chamber 62 and the plunger arm 126 and plunger tip 124 are disposed immediately above portion 74 by support brackets 128 and 130 when the chamber 62 is received by station 110. This point is designated D in FIG. 5 and a partial section of the discharge station 110 at this point is shown in FIG. 6. As discharge assembly 104 rotates between points D and E in FIG. 5, the plunger arm 126 traverses a downwardly sloping section of cam 142 which causes it to move downward. As the plunger arm 126 drops, plunger tip 124 forces the portion 74 of fish from chamber 62 into container 114 in the manner shown in FIG. 7. Cam 142 and plunger tip 124 are at their lowest vertical position at point E. From there, continued rotation of discharge station 110 back toward the transfer subsystem 16 at point F causes station 110 to traverse an upwardly sloping section of cam 142. Ultimately, plunger tip 124 rises and achieves its highest elevation 180° from point E.

Before the discharge station 110 reaches the return section of transfer subsystem 16, the projecting arm 154 removes the filled container 114 from the horizontally disposed platform 112, at the point designated G in FIG. 5. Finally, at point F, return chamber guide wheel 84 and guide rail surface 86 engage the measuring chamber 62, transferring it from discharge subsystem 18 back to the chamber guide wheel 64 of measuring subsystem 14. From here, the process repeats itself.

As will be appreciated, the variation in operational speeds of measuring subsystem 14 and discharge subsystem 18 is attributable to different requirements of the two substations. More particularly, while the measuring process can be performed relatively rapidly, discharge of the portion 74 of fish into container 114 is slowed by the fact that air must be allowed to escape from the container 114. While this is accomplished in the preferred embodiment by the use of the offset and smaller plunger tip 124 described above, some delay is still incurred. Alternatively as described in more detail below, evacuating air from the containers before introducing the filler material into the containers can be accomplished by heating the containers with steam followed by rapidly cooling the containers with a cold water spray. More particularly, it is believed that the measuring subsystem 14 can operate effectively three times as fast as the discharge subsystem 18. For that reason, a measuring subsystem 14 that produces a single portion 74 per revolution is used in connection with a discharge subsystem 18 that fills three containers per revolution.

In another aspect, a container filling system formed in accordance with the present invention is capable of producing more than one filled measuring chamber 62 per rotation of the measuring station. Referring to FIG. 11, a container filling system formed in accordance with this aspect of the present invention includes a measuring station 14 that includes four vertical tubular sections 208 for introducing filler material into measuring chambers 62 positioned below tubular sections 208. The four tubular sections 208 allow the measuring station 14 to fill four measuring chambers 62 per rotation of the measuring station. It should be understood that the axes of rotation for the forward chamber guide wheel 80, rotating timing wheel 149, horizontal chamber guide wheel 64, return chamber guide wheel 84, and discharge subsystem 18 are the same as those described above with reference to FIGS. 1 through 9. The primary difference between the components of a container filling system formed in accordance with this aspect of the present invention relates to a four-fold increase in the features of the individual components that handle the measuring chambers 62 and containers 114. Because the measuring station can fill four measuring chambers 62 per rotation, means must be provided for providing and removing four measuring chambers per rotation to and from the measuring station. As can be seen in FIG. 11, this is accomplished by providing four recesses 90*a*–90*d* in forward guide wheel 80, four recesses 92*a*–92*d* in return chamber guide wheel 84, four recesses (not shown) in timing wheel 149 (not shown), four recesses 68*a*–*d* in horizontal chamber guide wheel 64, and twelve discharge stations 110. The operation of the individual components is substantially the same as that described above with reference to FIGS. 1 through 9; however, as discussed above this aspect of the present invention can produce four filled measuring chambers per revolution of the measuring station. It should be understood that the cooperation between the individual components is substantially the same as that described above with reference to FIGS. 1 through 9 and will be briefly described in the following description of FIGS. 10 through 14.

Individual discharge stations 110 of discharge subsystem 18 are virtually identical to those described hereinabove with regard to FIGS. 1 through 9 however, the discharge subsystem 18 includes twelve discharge stations 110 rather than three to accommodate the increased measuring chamber output per rotation from measuring station 14. As describe above, discharge stations 110 receive measuring chambers 62 filled with filler material and empty containers 114 and discharge the filler material from measuring chambers 62 into containers 114. Discharge subsystem 18 can also include a means for evacuating air out of empty containers 114 just prior to discharging the filler material from measuring chambers 62 into containers 114. This is particularly advantageous when containers 114 are of the size and shape commonly known in the fish canning industry as a one-pound can.

One means for evacuating air out of containers 114 includes a steam jet generally indicated by reference 246 that directs steam into containers 114 or onto the outer surface of containers 114 immediately after they are received onto discharge station 110. Immediately after the steam jet 246, a cold water spray 248 is directed onto the outer surface of containers 114 to rapidly cool the air within containers 114 which serves to evacuate the air out of the containers. To be effective in the context of a container filling system formed in accordance with the present invention, the heating step and cooling step must be completed prior to beginning the discharge of the filler material from measuring chambers 62 into containers 114.

With regard to the relative movement of containers 114 and measuring chambers 62 through the forward chamber guide wheel 80, rotating timing wheel 149, return chamber guide wheel 84, projecting arm 154, and rail 83, the cooperation between these elements is substantially the same as described above with reference to FIGS. 1 and 5.

Briefly summarizing, rotating timing wheel 149 positioned directly below forward chamber guide wheel 80 receives a container 114 into a recess and transfers container 114 to discharge station 110*a*. Forward chamber guide wheel 80 that is positioned directly above rotating timing wheel 149, and whose recesses 90*a*–*d* are vertically aligned with the recesses in rotating timing wheel 149, receives measuring chamber 62 from horizontal chamber guide wheel 64 after measuring chamber 62 has been filled with filler material. Forward chamber guide 80 transports filled measuring chamber 62 to discharge station 110*a*. Discharge station 110*a* then rotates around hub 102 to discharge filler material from measuring chamber 62 into container 114. Container 114 is displaced from discharge station 110*a* by projecting arm 154. The filled container 114 is carried away from the container filling system by conveyor system 157. Empty measuring chamber 62 continues on with discharge station 110*a* until return chamber guide wheel 84 engages discharge station 110*a* and receives measuring chamber 62 in recess 92*b*. Return chamber guide wheel 84 transports measuring chamber 62 back to horizontal chamber guide wheel 64. Measuring chamber 62 is received into recess 68*b* and rotated around the primary axis as it is filled with filler material from the tubular sections 208, thus beginning the filling process again.

Figure 10:
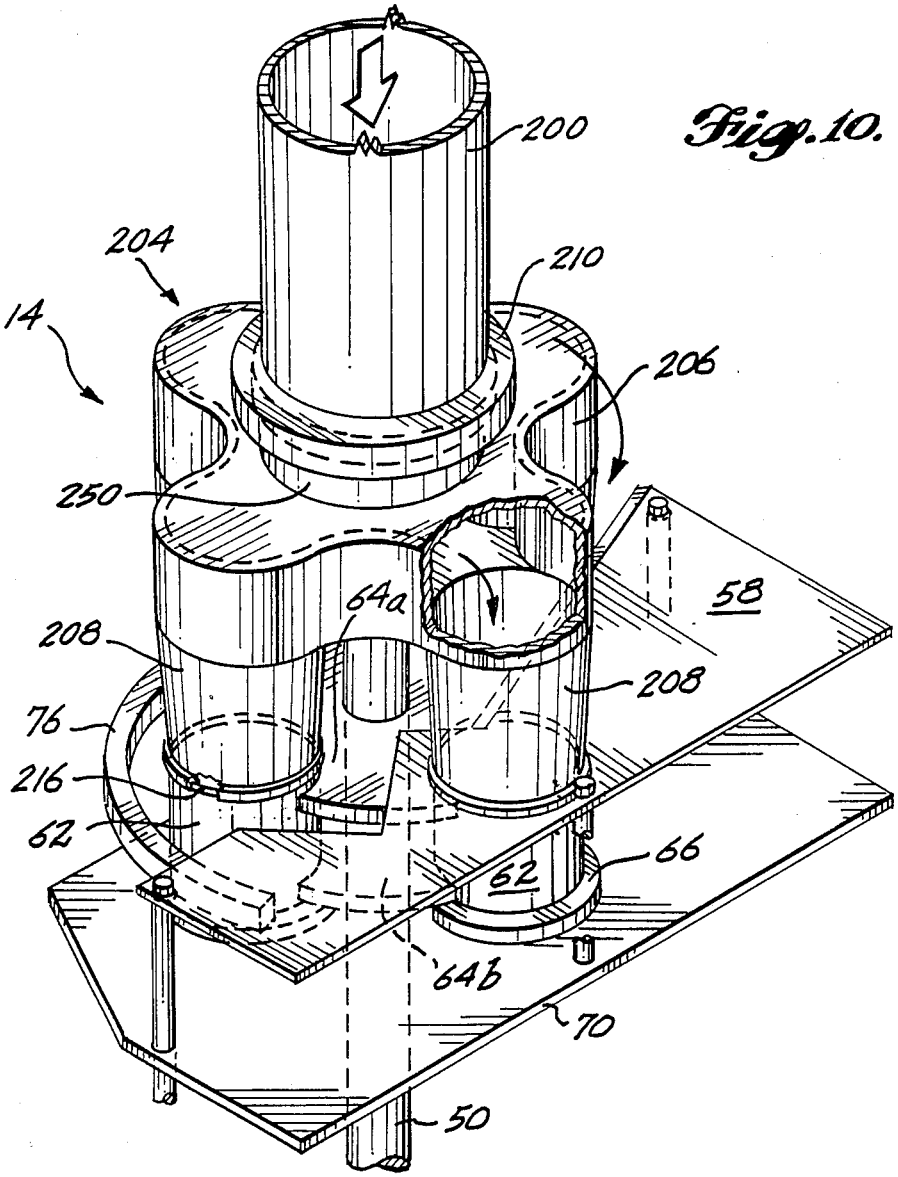
FIG. 10 is an isometric view of another rotatable measuring station formed in accordance with the present invention.
Figure 11:
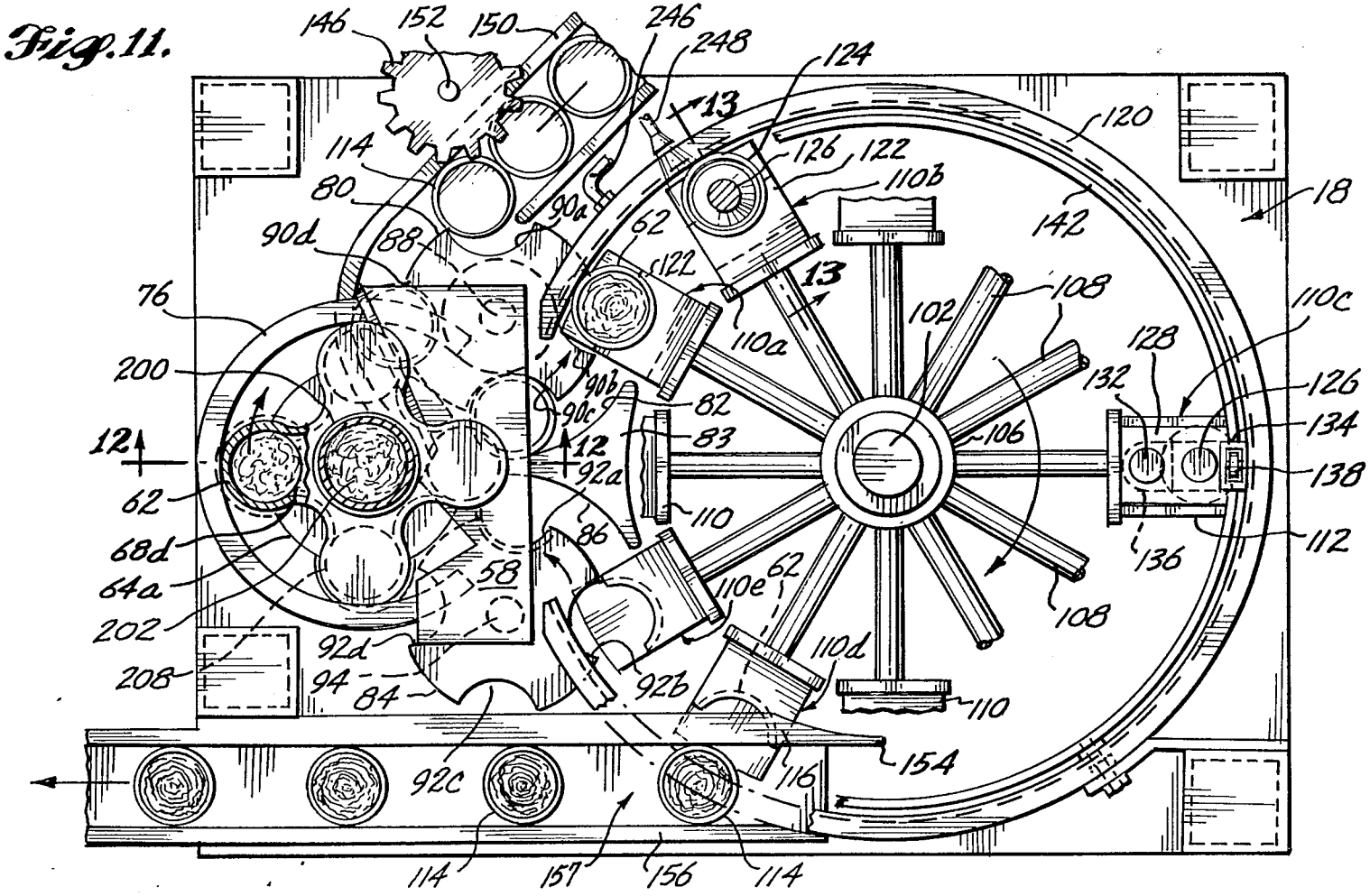
FIG. 11 is a plan view of the top of another container filling system formed in accordance with the present invention.
Figure 12:
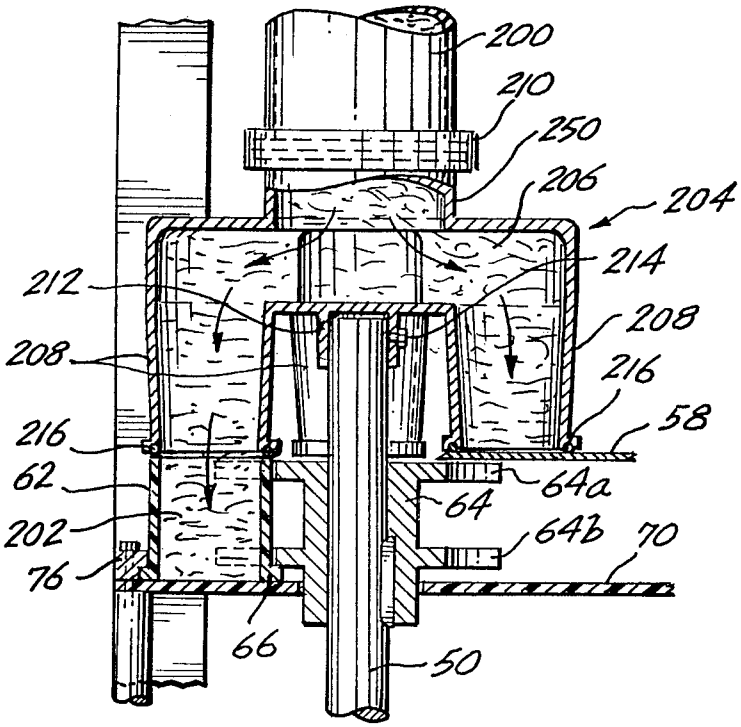
FIG. 12 is a sectional view of the side elevation of the rotatable measuring station of FIG. 10.

Referring additionally to FIGS. 10 and 12 in more detail, the feed means for directing filler material from the material feed subsystem 12 to the measuring chambers 62 includes a housing 204 having an upper distribution chamber 206 for receiving the filler material from the material feed subsystem 12, and at least two lower tubular sections 208 for guiding the filler material from the upper distribution chamber 206 to measuring chambers 62 that are positioned directly below the respective tubular sections 208. To simplify the description of the structure, the filler material has been omitted from FIG. 10. The center of upper surface of the housing 204 includes a circular opening defined by a vertical cylinder 250. The top of vertical cylinder 250 is rotatably coupled and sealed to the bottom of stationary feed tube 200 by a sanitary couple 210. Feed tube 200 is held stationary while housing 204 and tubular sections 208 are coupled to vertical shaft 50 by flange 212 and pin 214 and are capable of rotating about a primary axis by rotation of vertical shaft 50. Distribution chamber 206 is defined by four vertical cylinders whose centers are positioned 90° offset from each other on a circle that is positioned concentrically relative to the center of vertical cylinder 250. The diameter of the circle defined by the centers of the four vertical cylinders is such that the circumference of the individual vertical cylinders are just adjacent to (i.e., tangential to) the outer circumference of vertical cylinder 250.

In a top plan view, the periphery of housing 204 resembles a four-leaf clover. The cylindrical portions of the distribution chamber 206 directly above tubular sections 208 have a constant diameter. The upper ends of the cylinders are closed while the bottoms of the cylinders open into tubular sections 208. The upper end of tubular sections 208 have a diameter substantially equal to the diameter of the vertical cylinders of the distribution chamber 206. The lower end of the tubular sections 208 have a diameter that is slightly less than the diameter of the upper end of tubular sections 208 and is slightly less than the inner diameter of measuring chamber 62. The lower end of tubular sections 208 also includes a seal 216 to prevent or minimize escape of filler material as the filler material is delivered to measuring chambers 62.

Filler material is introduced into the distribution chamber 206 from the material feed subsystem via stationary tube 200 under pressure and in virtually plug flow. The filler material fills the distribution chamber 206 and is guided into tubular sections 208 where, depending on the position of tubular section 208 with respect to knife plate 58, filler material either flows into a measuring chamber 62 or is prevented from flowing into a measuring chamber 62. If tubular section 208 is separated from a measuring chamber 62 by knife plate 58, then the filler material cannot flow into measuring chamber 62 until rotation of the housing 204 causes the specific tubular section 208 to pass over the trailing edge of knife plate 58. Once tubular section 208 passes over the trailing edge of knife plate 58, the filler material flows into measuring chamber 62 that is directly below tubular section 208. As tubular section 208 and measuring chamber 62 approach the leading edge of knife plate 58, and knife plate 58 passes between the lower edge of tubular section 208 and the upper edge of measuring chamber 62, the leading edge cleanly severs the filler material and separates the lower end of tubular section 208 and upper end of measuring chamber 62. As the tubular section 208 and filled measuring chamber 62 continue to rotate, measuring chamber 62 is transferred to forward chamber guide wheel 80 for transport to discharge station 110*a*.

Referring to FIG. 10, when larger one-pound cans are to be filled by a container filling system formed in accordance with the present invention, horizontal chamber guide wheel 64 includes an upper wheel 64*a* and a lower wheel 64*b* that are integrally attached to vertical drive shaft 50. Recesses 68*a*–68*d* in the periphery of wheels 64*a* and 64*a* engage measuring chambers 62 at both the top and bottom ensuring stable engagement of the chambers by the wheels. Guide rail 76 includes a track for receiving boss 66 on the lower end of measuring chambers 62 that serves to maintain the position of measuring chambers 62 in the recesses of guide wheels 64*a* and 64*b*. Using the feed means described with reference to FIGS. 10, 11, and 12, four measuring chambers 62 can be filled with filler material for each rotation of housing 204 by vertical shaft 50.

Figure 13:
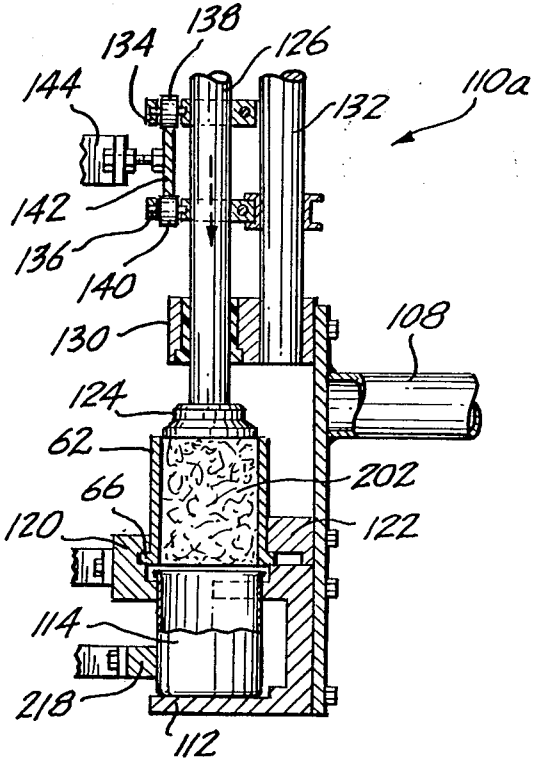
FIG. 13 is a sectional view of the side elevation of a portion of the discharge station of FIG. 11 illustrating the position of the discharge station prior to discharge of filler material into a container.

Referring to FIG. 13, discharge station 110*a* is illustrated for discharging filler material 202 from measuring chambers 62 into a one-pound container 114. The discharge station 110*a* is substantially the same as the discharge stations described hereinabove with regard to FIGS. 1 through 9 with the exception that the stroke of plunger 124 is longer to accommodate the increased height of measuring chambers 62. In addition, the vertical spacing between horizontal platform 112 for containers 114 and guide rail 120 is increased to accommodate the increased height of containers 114. Also, an additional lower guide rail 218 is provided to bear inwardly against the lower portion of containers 114 to help maintain the containers on platform 112. Operation of discharge station 110 is substantially the same as that described hereinabove with regard to FIGS. 1 through 9.

Figure 14:
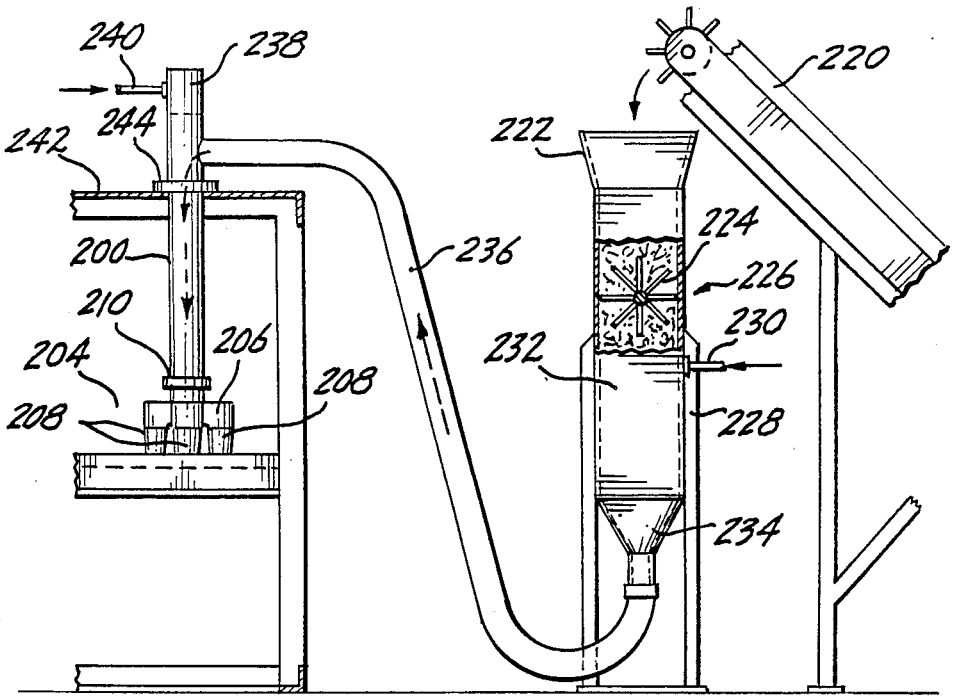
FIG. 14 is a pictorial view of a feed subsystem formed in accordance with the present invention.

Referring to FIG. 14, a preferred material feed subsystem 12 for providing filler material to the feed means of measuring station 14 includes a conventional conveyor 220 for introducing amorphous material, e.g., fillets of whole fish, into a hopper 222. From hopper 222 the filler material is directed by a rake 224 rotating about a horizontal axis into a controlled pressure tank or vessel 232. Controlled pressure tank 232 is sealed by an air lock 226 provided around rake 224. A pressurized air line 230 serves to maintain the pressure within controlled pressure tank 232 at a predetermined level. Bottom 234 of controlled pressure tank 232 is truncated and connected to a flexible conduit 236 by a sanitary couple. Hopper 222, rake 224, air lock 226, and controlled pressure tank 232 are supported by support structure 228. Filler material enters conduit 236 in essentially plug flow and passes through conduit 236 into stationary vertical feed tube 200. Directly above the point where flexible conduit 236 enters feed tube 200, an air chamber is provided for monitoring and adjusting the pressure within flexible conduit 236 and feed tube 200. Pressurized air is provided to air chamber 230 by conduit 240. Vertical feed tube 200 is seated at 224 into support structure 242 for the container filling system formed in accordance with the present invention. As described hereinabove in more detail, vertical feed tube 200 is coupled to housing 204 of the feed means by a sealed bearing 210 that allows the housing 204 to rotate as the vertical feed tube 200 is held stationary by seating 244. The filler material enters the distribution chamber 206 of housing 204 under pressure and is distributed to vertical tubular sections 208 for introduction into measuring chambers 62 as described hereinabove.

The amount and speed with which filler material is introduced into individual measuring chambers 62 is controlled by adjusting the pressure on the filler material that is introduced into the distribution chamber. Control of the pressure can be accomplished by monitoring and adjusting the level of filler material in the controlled pressure tank 232, as well as monitoring and adjusting the pressure above the filler material in the controlled pressure tank 232. The necessary pressure adjustments in tank 232 can be made via pressurized air line 230. The pressure in air chamber 238 can be monitored and adjusted through pressurized air line 240. Careful control of the pressure and the speed of the container filling system ensures that reproducible amounts of filler material are introduced into measuring chambers 62.

Those skilled in the art will recognize that the embodiments of the invention disclosed herein are exemplary in nature and that various changes can be made therein without departing from the scope and the spirit of the invention. In this regard, the invention may be readily employed to discharge various filler materials into different container types and sizes. For example, certain nonhomogeneous media that are incapable of achieving a uniform density when compressed may be dispensed by the disclosed system to provide closely controlled volumes of material to a container. Also, amorphous or substantially homogeneous materials can be dispensed by a container filling system formed in accordance with the present invention. Examples of amorphous materials include fillets of whole fish, sauces, puddings, jellies, jams, condiments, meat products, poultry products, moist pet foods, semi-liquid compositions and the like under pressure. Further, the exact construction of, for example, the guide wheels and rails can be varied as desired. Similarly, the discharge assembly could be constructed as a continuous wheel and could employ a variety of cam contours. The embodiments described above include three discharge stations for each measuring chamber that can be filled per revolution of the measuring station. For proper synchronization of the measuring station and the discharge stations, the measuring station rotates at a speed three times as fast as the discharge stations. It should be understood that the number of discharge stations per measuring chamber that can be filled per revolution of the measuring station can be greater than or less than three as long as the relative speed of the discharge stations, measuring stations, and other subsystems is adjusted accordingly. Because of the above and numerous other variations and modifications that will occur to those skilled in the art, the following claims should not be limited to the embodiments illustrated and discussed herein.

The embodiments of the invention in which an exclusive property or privilege is claimed are defined as follows:

1. A container filling system for introducing controlled volumes of filler material into containers, the system comprising:

measuring means for receiving a predetermined volume of filler material, said measuring means rotatable about a primary axis;

rotatable feed means for introducing filler material into at least two of said measuring means upon each rotation of said feed means, said feed means introducing said filler material into said measuring means under pressure and along a first axis defined with respect to said measuring means; and discharge means for discharging filler material from said measuring means along the first axis and into a container, said discharge means rotatable about a secondary axis different from the primary axis.

2. The container filling system of claim 1, wherein said feed means includes a housing for directing the filler material to said measuring means, the housing including a distribution chamber and at least two tubular sections for transferring the filler material from the distribution chamber to said measuring means.

3. The container filling system of claim 2, wherein the at least two tubular sections include a portion in the shape of a truncated cone for compressing the filler material as the filler material passes through the at least two tubular sections.

4. The container filling system of claim 2, wherein said rotatable feed means further comprises:

a vessel for continuously receiving filler material under pressure; and a conduit for transferring the filler material under pressure from said vessel to the housing.

5. The container filling system of claim 4, wherein the conduit comprises:

a primary section and a secondary section, said primary section including a vertically oriented tube in fluid communication between said secondary section and said housing, said primary section having a longitudinal axis the same as the primary axis, said secondary section in fluid communication between said vessel and said primary section.

6. The container filling system of claim 5, wherein said primary section is stationary.

7. The container filling system of claim 4, wherein said vessel further comprises:

an air lock for maintaining the filler material under pressure as additional filler material is introduced into said vessel.

8. The container filling system of claim 1, wherein said rotatable feed means includes a housing for directing the filler material to said measuring means, the housing including a distribution chamber and four tubular sections for transferring the filler material from the distribution chamber to said measuring means.

9. The container filling system of claim 8, wherein said discharge means includes twelve vertically displaceable plungers, each displaceable plunger for discharging the filler material from one measuring means into a container.

10. The container filling system of claim 8, further comprising:

a rotatable measuring station for controlling introduction of filler material from said rotatable feed means into said measuring means:

twelve rotatable discharge stations for controlling the discharge by the discharge means of filler material from a measuring means into a container, each discharge station being rotated about the secondary axis at approximately one-third the speed of said rotatable measuring station; and transfer means for transferring said measuring means between said rotatable measuring station and said rotatable discharge stations.

11. The container filling system of claim 1, further comprising transfer means for transferring said measuring means from said rotatable feed means to said discharge means.

12. The container filling system of claim 4, further comprising:

a rotatable measuring station for controlling the introduction of filler material from said rotatable feed means into said measuring means;

a rotatable discharge station for controlling the discharge by the discharge means of filler material from said measuring means into a container; and transfer means for transferring said measuring means between said rotatable measuring station and said rotatable discharge station.

13. The container filling system of claim 12, wherein said rotatable measuring station further comprises a stationary knife plate disposed immediately below said at least two tubular sections of said feed means, said knife plate being dimensioned to intermittently block said at least two tubular sections and sever the filler material between said measuring means and said at least two tubular sections after said measuring means is filled.

14. The container filling system of claim 13, wherein said rotatable discharge station comprises:

a vertically displaceable plunger being rotatable about the secondary axis different from the primary axis in synchronization with said transfer means;

a cam assembly fixed about the secondary axis, said cam assembly cooperatively coupled to said plunger to control the vertical displacement of said plunger; and a stationary support structure for supporting the filler material in said measuring means until said measuring means is positioned over a container, said support structure and cam assembly being relatively oriented to allow said plunger to discharge filler material from said measuring means into the container when the measuring means is positioned over the container.

15. The container filling system of claim 1, wherein said filler material is substantially homogeneous material.

16. The container filling system of claim 15, wherein said filler material is selected from the group of substantially homogeneous materials consisting of fillets of whole fish, sauces, puddings, jellies, jams, condiments, meat products, poultry products, and pet foods.

17. The container filling system of claim 16, wherein said filler material comprises fillets of whole fish.

18. A container filling system for introducing controlled volumes of filler material into containers, the system comprising:

measuring means for receiving a predetermined volume of filler material, said measuring means including a rotatable measuring station for controlling the introduction of filler material into said measuring means, said measuring means being rotatable about a primary axis;

rotatable feed means for introducing filler material into at least two of said measuring means upon each rotation of said feed means, said feed means introducing said filler material into said measuring means under pressure and along a first axis defined with respect to said measuring means;

discharge means for discharging filler material from said measuring means along the first axis and into a container, said discharge means being rotatable about a secondary axis different from the primary axis and including a rotatable discharge station for controlling the discharge of filler material by the discharge means from the measuring means into a container; and transfer means for transferring said measuring means from said rotatable measuring station to said discharge means, said rotatable measuring station including a stationary knife plate disposed immediately below said rotatable feed means, said knife plate being dimensioned to alternatively block said feed means and sever the filler material between said measuring means and said feed means after said measuring means is filled.

19. The container filling system of claim 18, wherein said rotatable feed means includes a vessel for receiving filler material under pressure, a housing for directing filler material to said measuring means, the housing including a distribution chamber and at least two tubular sections for transferring filler material from the distribution chamber to the measuring means, and a conduit for transferring the filler material from the vessel to the housing.

20. The container filling system of claim 18, wherein said rotatable discharge station comprises:

a vertically displaceable plunger being rotatable about the secondary axis in synchronization with said transfer means;

a cam assembly fixed about the secondary axis, said cam assembly cooperatively coupled to said plunger to control the vertical displacement of said plunger; and a stationary support structure for supporting the filler material in said measuring means until said measuring means is positioned over a container, said support structure and cam assembly being relatively oriented to allow said plunger to discharge filler material from said measuring means into a container when said measuring means is positioned over a container.

* * * * *